US012516465B2

(12) United States Patent
Campos et al.

(10) Patent No.: US 12,516,465 B2
(45) Date of Patent: Jan. 6, 2026

(54) LAUNDRY APPLIANCE INCLUDING A FILTERING AGITATOR HAVING AN INTERNAL FLUID PUMPING STRUCTURE

(71) Applicant: WHIRLPOOL CORPORATION, Benton Harbor, MI (US)

(72) Inventors: Anayancy Campos, Nuevo León (MX); James Jeffery, St. Joseph, MI (US); Eric W. Merrow, Benton Harbor, MI (US); Sayer J. Murphy, St. Joseph, MI (US); Brian D. Peschke, St. Joseph, MI (US); Erica L. Pinto, St. Joseph, MI (US); Ryan Rutter, St. Joseph, MI (US); Aliander F. Silva, São Paulo (BR); Thomas D. Spicer, St. Joseph, MI (US); Eric J. Vasko, St. Joseph, MI (US); David Walter, St. Joseph, MI (US); Mahendra S. Wankhede, Pune (IN); B. Shiva, Hyderabad (IN)

(73) Assignee: Whirlpool Corporation, Benton Harbor, MI (US)

( * ) Notice: Subject to any disclaimer, the term of this patent is extended or adjusted under 35 U.S.C. 154(b) by 554 days.

(21) Appl. No.: 17/984,526

(22) Filed: Nov. 10, 2022

(65) Prior Publication Data

US 2023/0160133 A1 May 25, 2023

Related U.S. Application Data

(60) Provisional application No. 63/281,828, filed on Nov. 22, 2021.

(51) Int. Cl.

| | |
|---|---|
| ***D06F 13/02*** | (2006.01) |
| ***D06F 17/10*** | (2006.01) |
| ***D06F 21/06*** | (2006.01) |
| ***D06F 39/10*** | (2006.01) |

(52) U.S. Cl.

CPC ..... *D06F 39/10* (2013.01); *D06F 13/02* (2013.01); *D06F 17/10* (2013.01); *D06F 21/06* (2013.01)

(58) Field of Classification Search

None

See application file for complete search history.

(56) References Cited

U.S. PATENT DOCUMENTS

| | | | |
|---|---|---|---|
| 2,942,444 | A | 6/1960 | Abresch |
| 2,976,711 | A | 3/1961 | Smith |
| 3,290,908 | A | 12/1966 | McAllister et al. |
| 3,314,253 | A | 4/1967 | Smith |
| 3,330,135 | A | 7/1967 | Douglas |
| 3,381,504 | A | 5/1968 | Smith |
| 3,724,242 | A | 4/1973 | Davis |
| 4,003,225 | A | 1/1977 | Worst |
| 4,848,105 | A | 7/1989 | O'Connell et al. |

(Continued)

FOREIGN PATENT DOCUMENTS

| | | | |
|---|---|---|---|
| EP | 4053326 | A1 | 9/2022 |
| WO | 2017119641 | A1 | 7/2017 |

*Primary Examiner* — Levon J Shahinian

(74) *Attorney, Agent, or Firm* — Price Heneveld LLP

(57) ABSTRACT

A washing appliance includes a tub positioned within an outer cabinet. A rotating drum rotates within the tub. A fluid flow path directs fluid through the tub and the drum. A rotator selectively rotates relative to the drum to generate at least a toroidal flow of the wash fluid through the drum and a supplemental flow of the wash fluid through a filter assembly positioned within the rotator.

20 Claims, 17 Drawing Sheets

(56) References Cited

U.S. PATENT DOCUMENTS

| | | | |
|---|---|---|---|
| 7,392,672 | B2 | 7/2008 | Kim et al. |
| 10,914,031 | B2 | 2/2021 | Piekarski et al. |
| 10,920,359 | B2 | 2/2021 | Piekarski et al. |
| 11,008,695 | B2 | 5/2021 | Piekarski et al. |
| 11,118,302 | B2 | 9/2021 | Piekarski et al. |
| 11,149,377 | B2 | 10/2021 | Lee et al. |
| 2003/0200774 | A1 | 10/2003 | Kim et al. |
| 2018/0313023 | A1 | 11/2018 | Piekarski et al. |
| 2019/0010655 | A1 | 1/2019 | Lee et al. |
| 2022/0010473 | A1 | 1/2022 | Lee et al. |
| 2022/0290357 | A1 | 9/2022 | Bhavsar et al. |

LAUNDRY APPLIANCE INCLUDING A FILTERING AGITATOR HAVING AN INTERNAL FLUID PUMPING STRUCTURE

CROSS REFERENCE TO RELATED APPLICATION

This application claims the benefit under 35 U.S.C. § 119(e) to U.S. Provisional Patent Application No. 63/281,828, filed Nov. 22, 2021, entitled "LAUNDRY APPLIANCE INCLUDING A FILTERING AGITATOR HAVING AN INTERNAL FLUID PUMPING STRUCTURE," which is incorporated herein by reference in its entirety.

BACKGROUND OF THE DISCLOSURE

The present disclosure generally relates to laundry appliances, and more specifically, a laundry appliance that includes an agitator or an impeller that incorporates a filtration element and an interior structure that can be used for pumping washing fluid through the agitator or impeller during operation of the appliance.

SUMMARY OF THE DISCLOSURE

According to one aspect of the present disclosure, a washing appliance includes a tub positioned within an outer cabinet. A rotating drum rotates within the tub. A fluid flow path directs wash fluid through the tub and the drum. A rotator selectively rotates relative to the drum to generate at least a toroidal flow of the wash fluid through the drum and a supplemental flow of the wash fluid through a filter assembly positioned within the rotator.

According to another aspect of the present disclosure, a washing appliance includes a tub positioned within an outer cabinet. A rotating drum rotates within the tub. A fluid flow path directs wash fluid through the tub and the drum. An agitator has a stem and a base and selectively rotates relative to the drum to generate a toroidal flow of the wash fluid through the drum and a supplemental flow of the wash fluid through a filter assembly is positioned within the stem of the agitator.

According to yet another aspect of the present disclosure, a washing appliance includes a tub positioned within an outer cabinet. A rotating drum rotates within the tub. A fluid flow path directs wash fluid through the tub and the drum. An impeller has a base and a filter assembly that is positioned within a top aperture of the base. Selective rotation of the impeller relative to the drum generates a toroidal flow of the wash fluid through the drum and a supplemental flow of the wash fluid through the filter assembly.

These and other features, advantages, and objects of the present disclosure will be further understood and appreciated by those skilled in the art by reference to the following specification, claims, and appended drawings.

Figure 1:
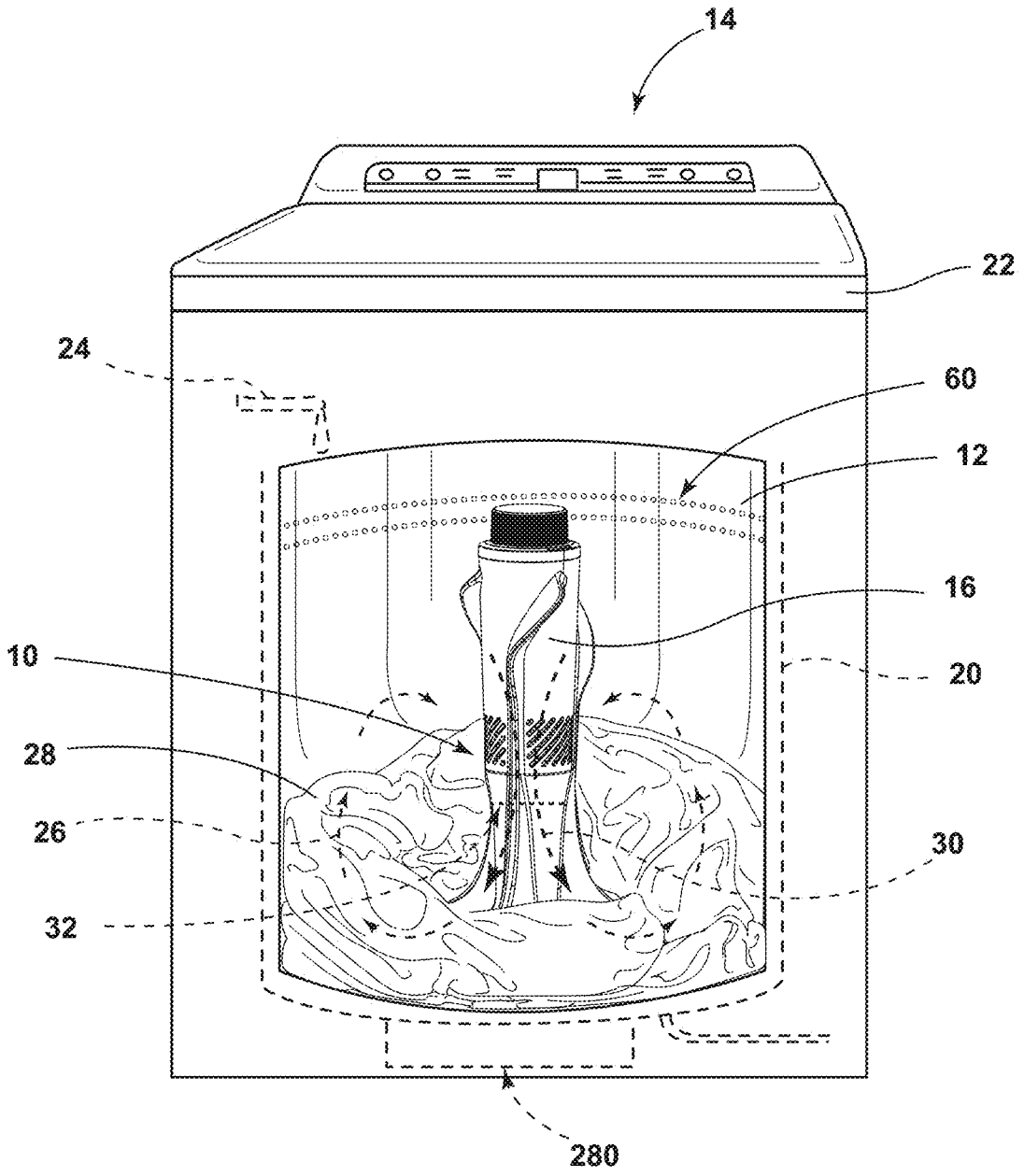
FIG. 1 is a schematic perspective view of a laundry appliance including an aspect of the agitator within a rotating drum.
Figure 2:
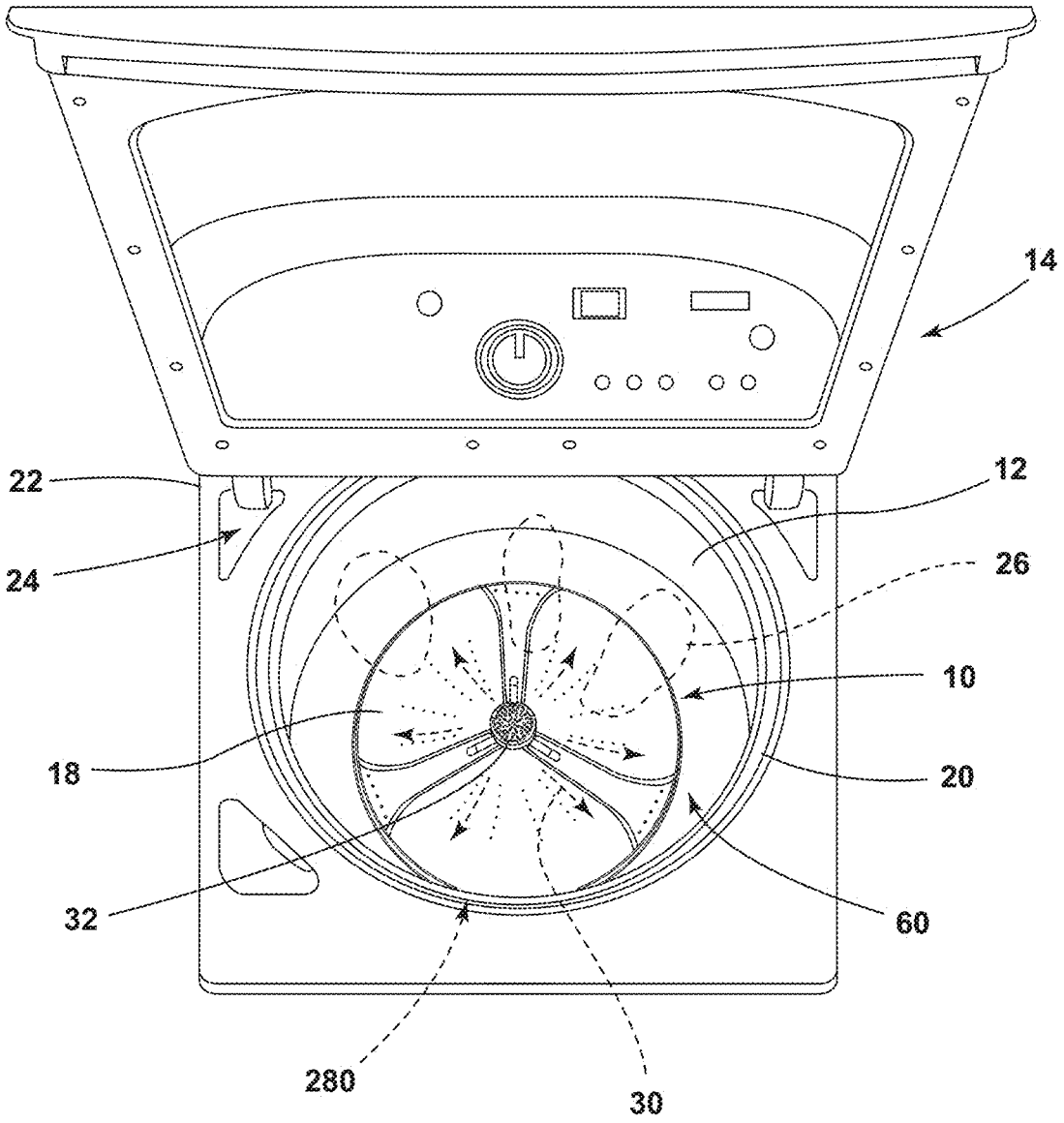
FIG. 2 is a top perspective view of a laundry appliance having an impeller that incorporates an aspect of the filtration element, the impeller shown within a rotating drum.

The components in the figures are not necessarily to scale, emphasis instead being placed upon illustrating the principles described herein.

DETAILED DESCRIPTION

The present illustrated embodiments reside primarily in combinations of method steps and apparatus components related to a filtering rotator in the form of an agitator or impeller that can be used to generate a toroidal flow of wash fluid within a rotating drum and also generate a supplemental flow of the wash fluid through the rotator for filtering the wash fluid within the filtering rotator. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-17, reference numeral 10 generally refers to a rotator that is positioned within a rotating drum 12 for an appliance 14, typically a washing appliance or a combination washing and drying appliance, where the rotator 10 can take the form of an agitator 16 or an impeller 18 that provides additional washing and cleaning capability within the appliance 14. According to various aspects of the device, the appliance 14 includes a tub 20 that is positioned within an outer cabinet 22. A rotating drum 12 rotates within the tub 20. A fluid flow path 24 directs wash fluid 28 through the tub 20 and the drum 12. A rotator 10 is selectively positioned within the rotating drum 12 and, in certain aspects, can be installed and removed by the user as desired. Selective rotation of the rotator 10 relative to the drum 12 generates at least a toroidal flow 26 of the wash fluid 28 through the drum 12. The rotator 10 also operates to generate a supplemental flow 30 of the wash fluid 28 through a filter assembly 32 that is positioned within the rotator 10, as will be described more fully herein.

Referring now to FIGS. 1 and 3-11, which correspond to the rotator 10 in the form of an agitator 16, the agitator 16 includes a base 50 and an exterior wall 52 that extends upward from the base 50 to form a stem 54. Within the stem 54, a plurality of external vanes 56 are included to produce the toroidal flow 26 of the wash fluid 28 within the rotating drum 12. Above the vanes 56 and typically between the vanes 56 are a plurality of fluid inlets 58 that provide for the movement of wash fluid 28 from the processing space 60 of the drum 12 and into the interior volume 62 of the stem 54 for the agitator 16. A plurality of fluid outlets 64 are positioned on the agitator 16 for allowing the wash fluid 28 to leave the interior volume 62 of the stem 54 for the agitator 16 for reintroduction into the toroidal flow 26 of wash fluid 28 within the rotating drum 12.

A plurality of structural ribs 66 are positioned within the base 50, and typically within an underside 68 of the agitator 16 to form an interior set of structural ribs 66. The interior set of structural ribs 66 operate to produce the supplemental flow 30 of wash fluid 28 that is directed through an interior flow path 70 of the agitator 16 between the fluid inlets 58 and the fluid outlets 64. These structural ribs 66 operate below the agitator 16 to produce a suction 72 within and through the agitator 16. This suction 72 produced by the rotating motion of the structural ribs 66 draws the wash fluid 28 from the rotating drum 12 and into the agitator 16 via the fluid inlets 58. Particulate material from laundry articles being processed is also carried into the interior volume 62 of the agitator 16. The suction 72 produced by the structural ribs 66 also draws the wash fluid 28, including the particulate material, from the fluid inlets 58 and through a removable filtration element 74 of the filter assembly 32. The removable filtration element 74 is positioned within the stem 54 of the agitator 16. The suction 72 generated by the structural ribs 66 of the agitator 16 further draws the wash fluid 28 from the filter assembly 32 and toward the fluid outlets 64 positioned within and through the base 50 of the agitator 16. As the wash fluid 28 is suctioned through the filtration element 74, the particulate material is separated from the wash fluid 28. The captured particulate material is held within a portion of the filtration element 74 for later disposal, as will be described more fully herein.

Figure 3:
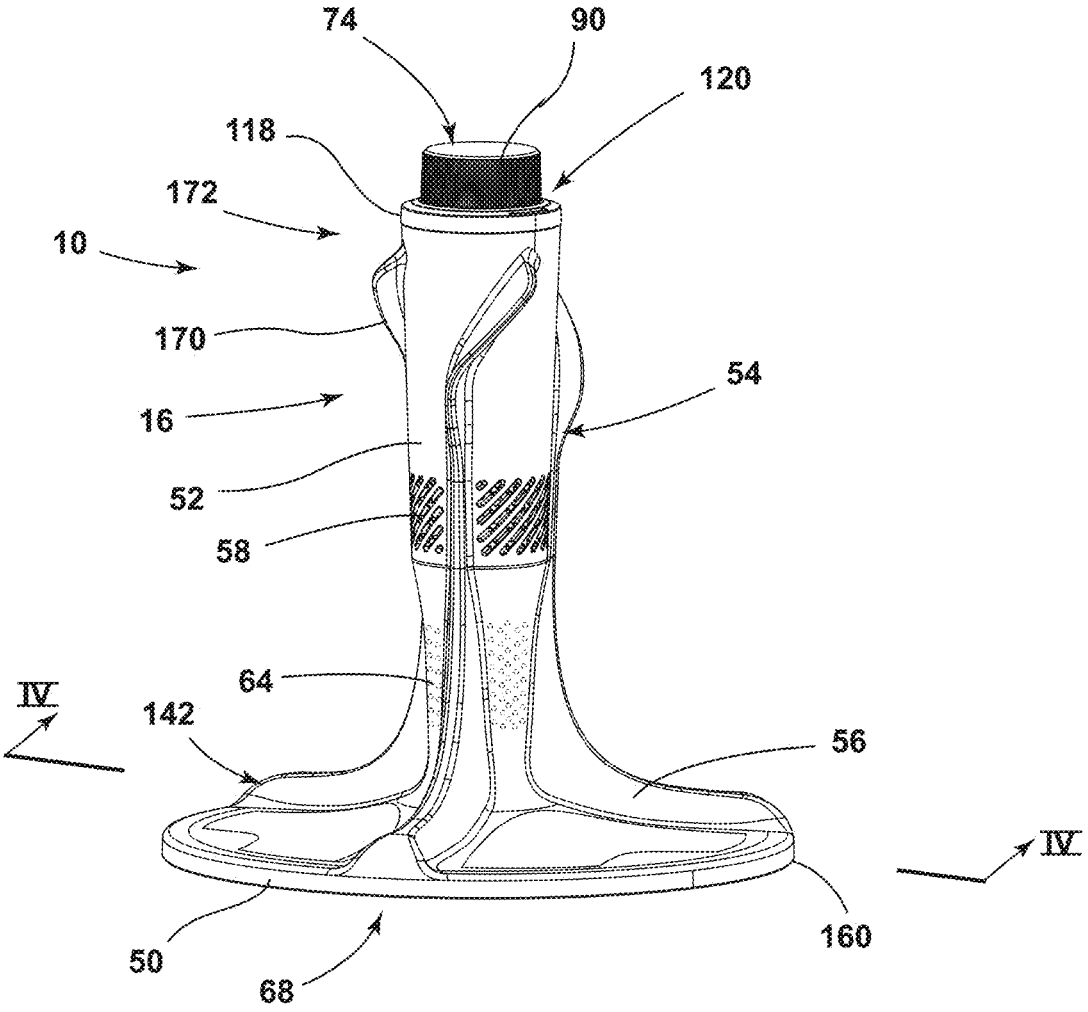
FIG. 3 is a side perspective view of an aspect of the agitator incorporating an aspect of a filtration element.
Figure 4:
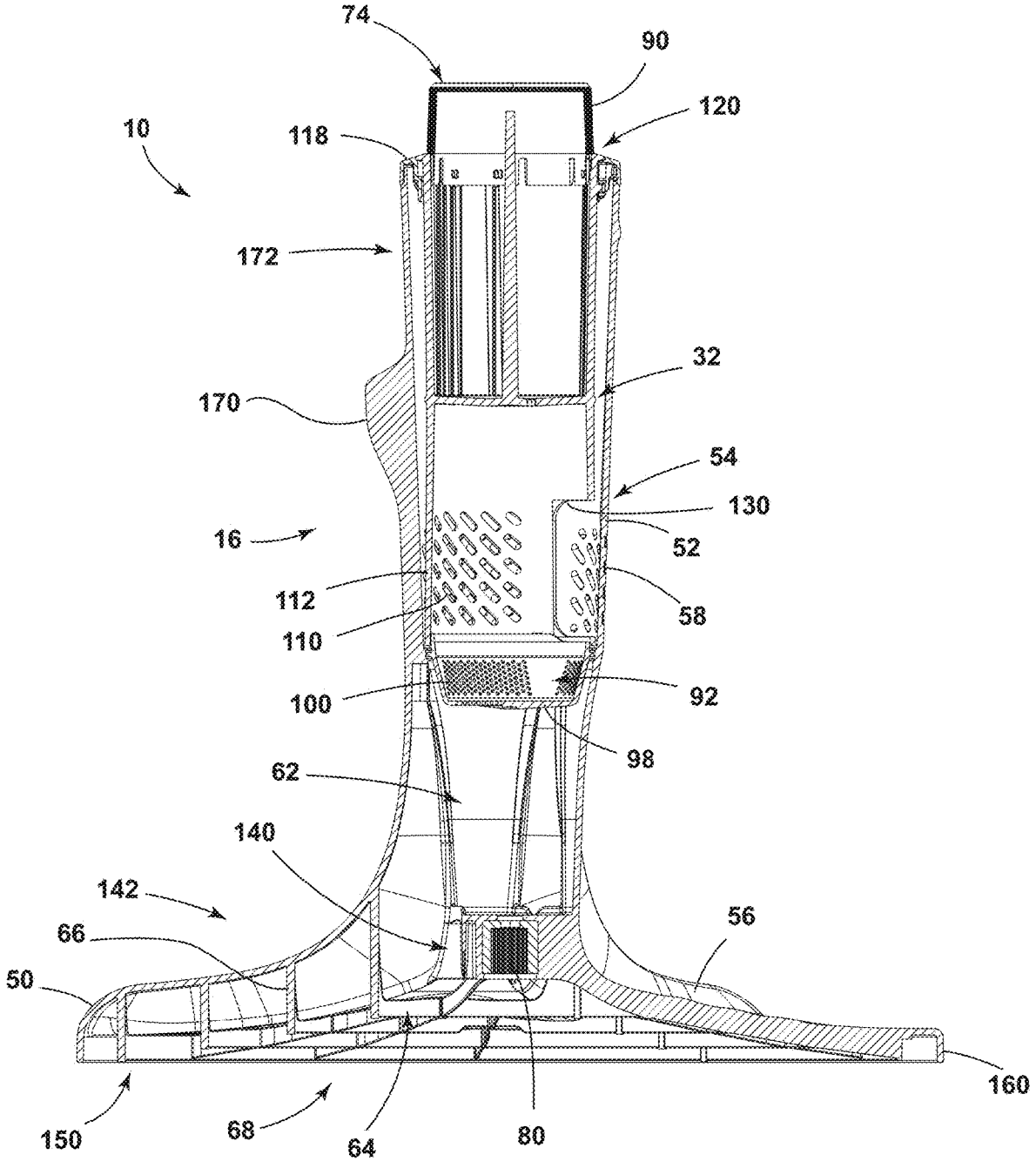
FIG. 4 is a cross-sectional view of the removable filtration element of FIG. 3 taken along line IV-IV.
Figure 5:
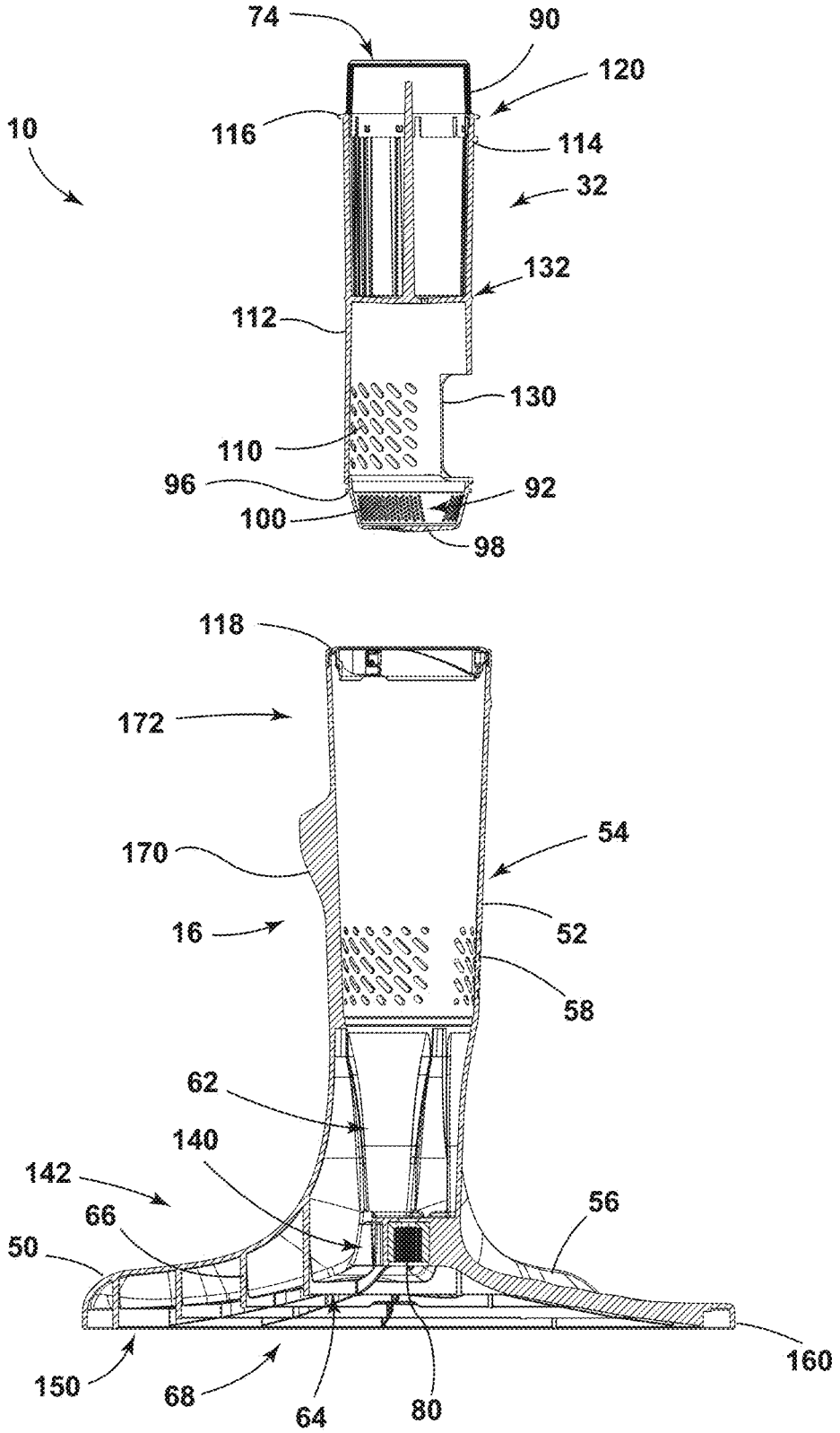
FIG. 5 is a partially exploded cross-sectional view of the agitator of FIG. 3.
Figure 6:
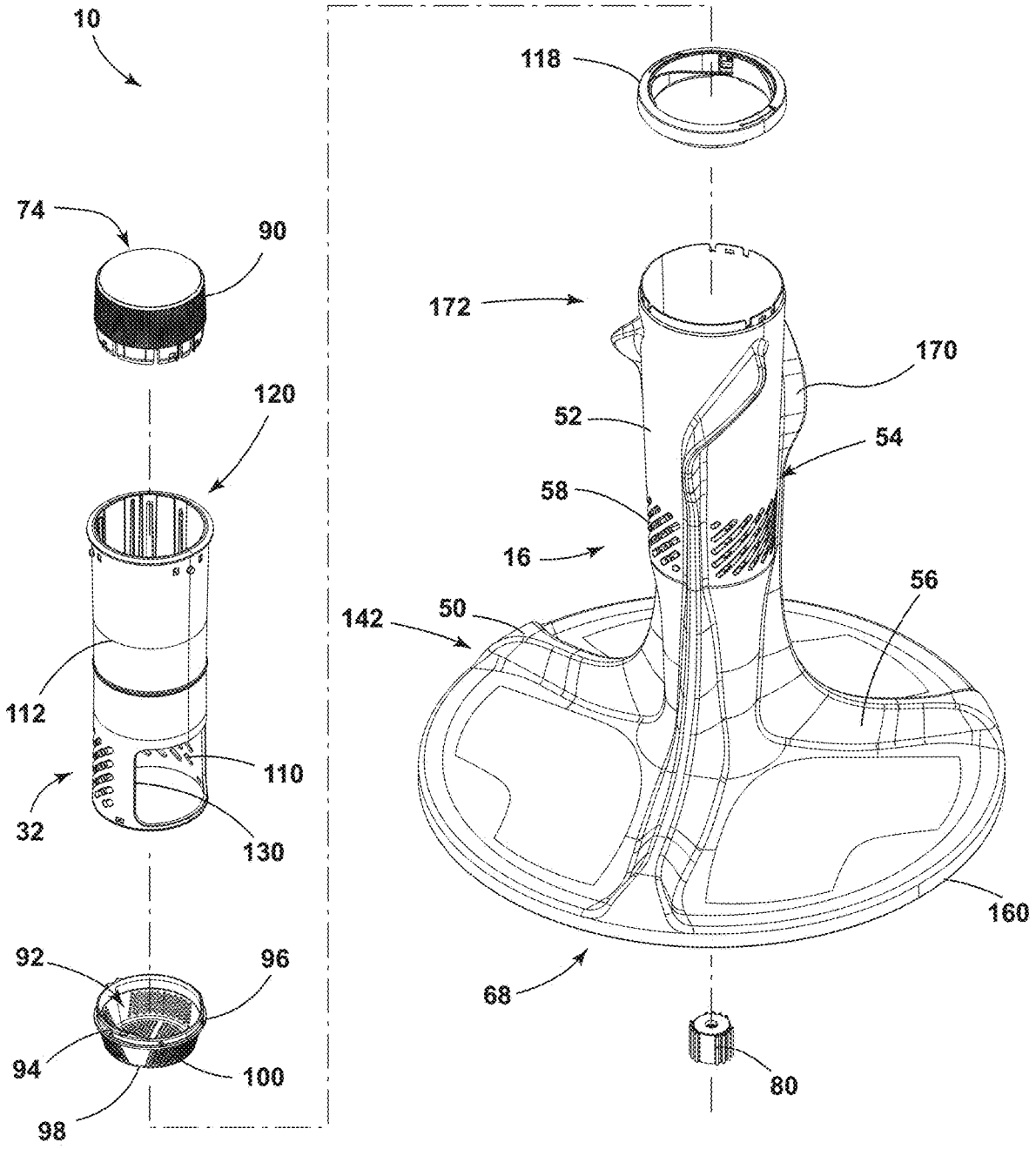
FIG. 6 is an exploded perspective view of the agitator of FIG. 3.
Figure 7:
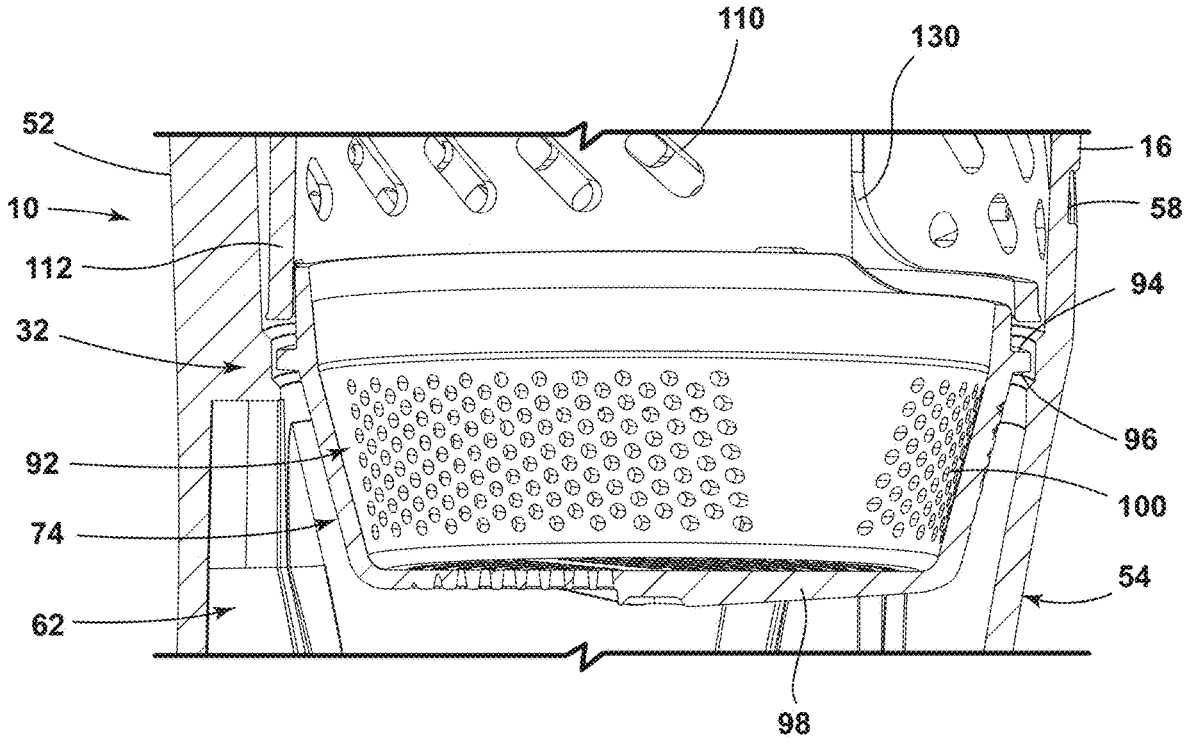
FIG. 7 is an enlarged cross-sectional view of a sealing engagement between the removable filtration element and the agitator of FIG. 3.
Figure 8:
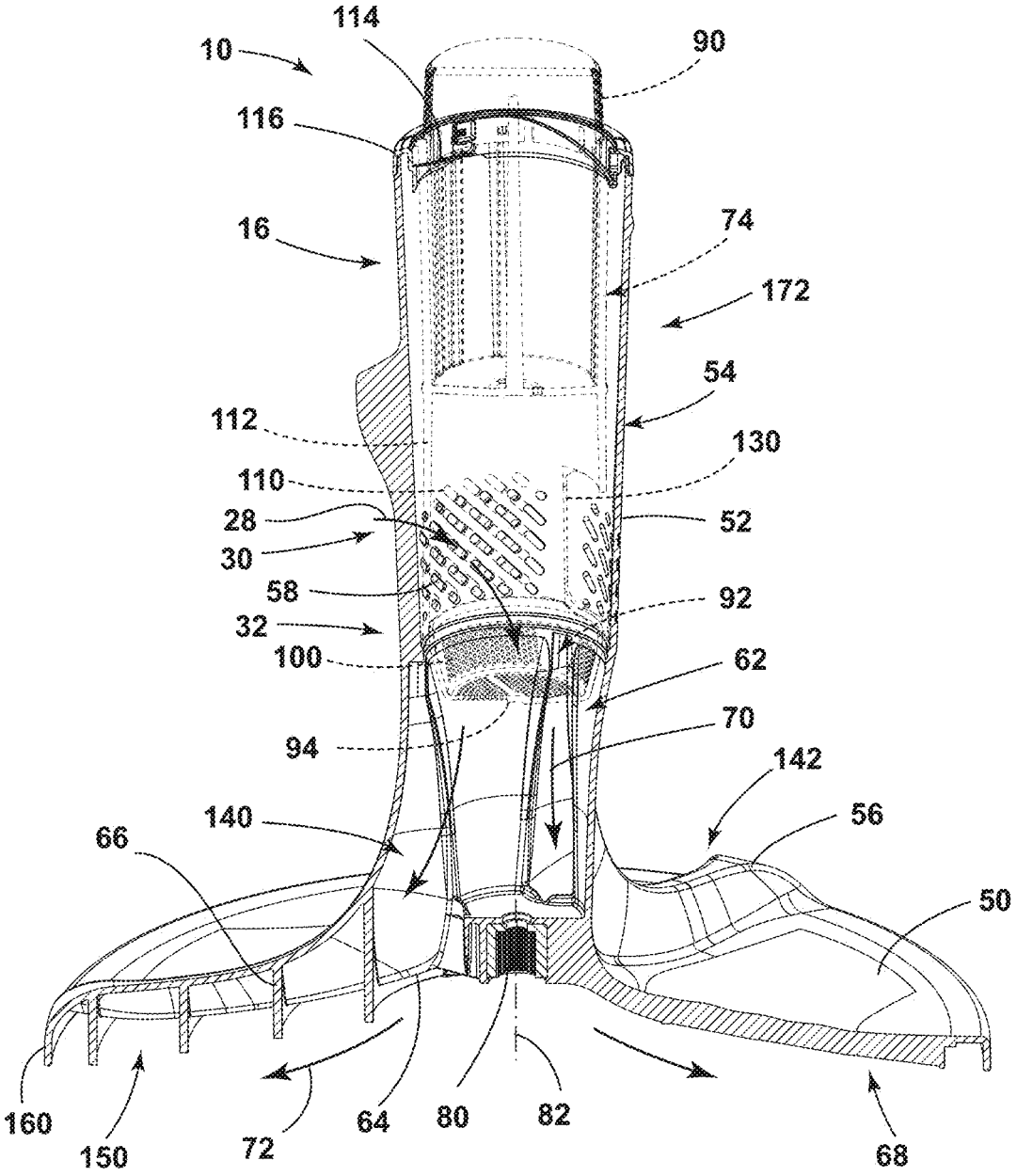
FIG. 8 is a schematic cross-sectional view of the agitator of FIG. 3 and showing movement of the wash fluid through the agitator and the filtration element.
Figure 9:
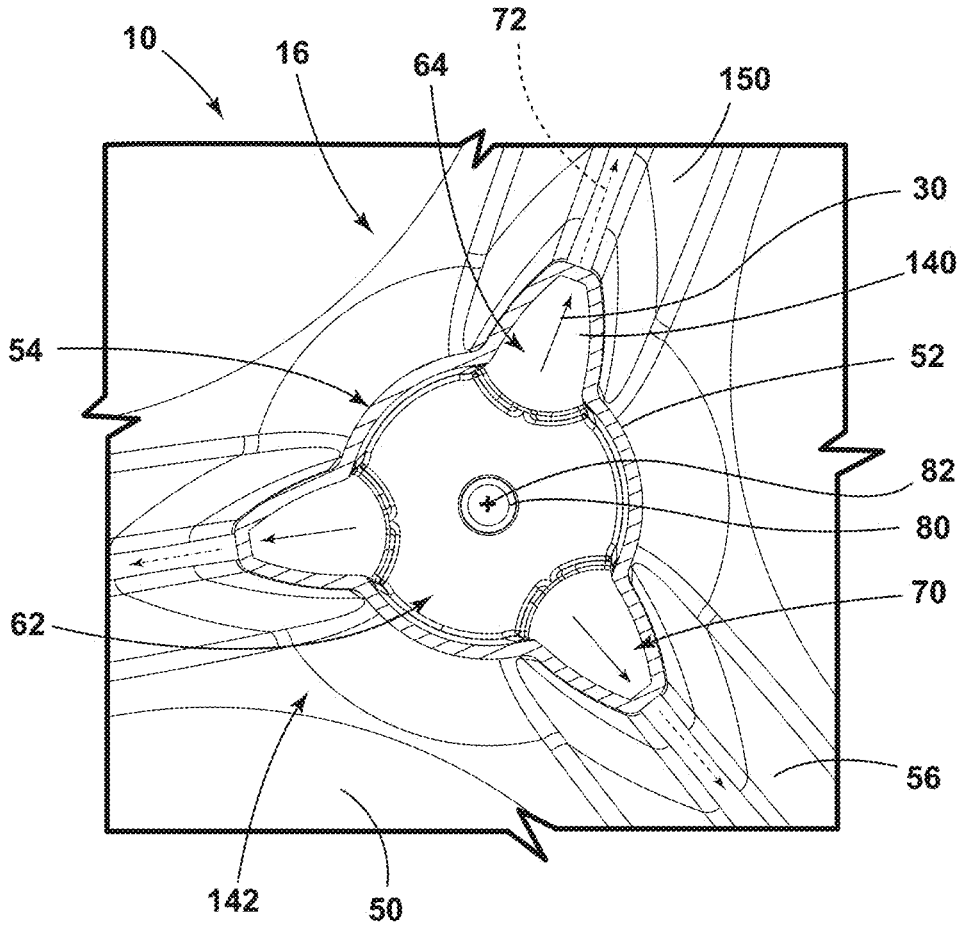
FIG. 9 is a lateral cross sectional view of the agitator of FIG. 3 and showing movement of the wash fluid into the flow channels of the agitator.
Figure 10:
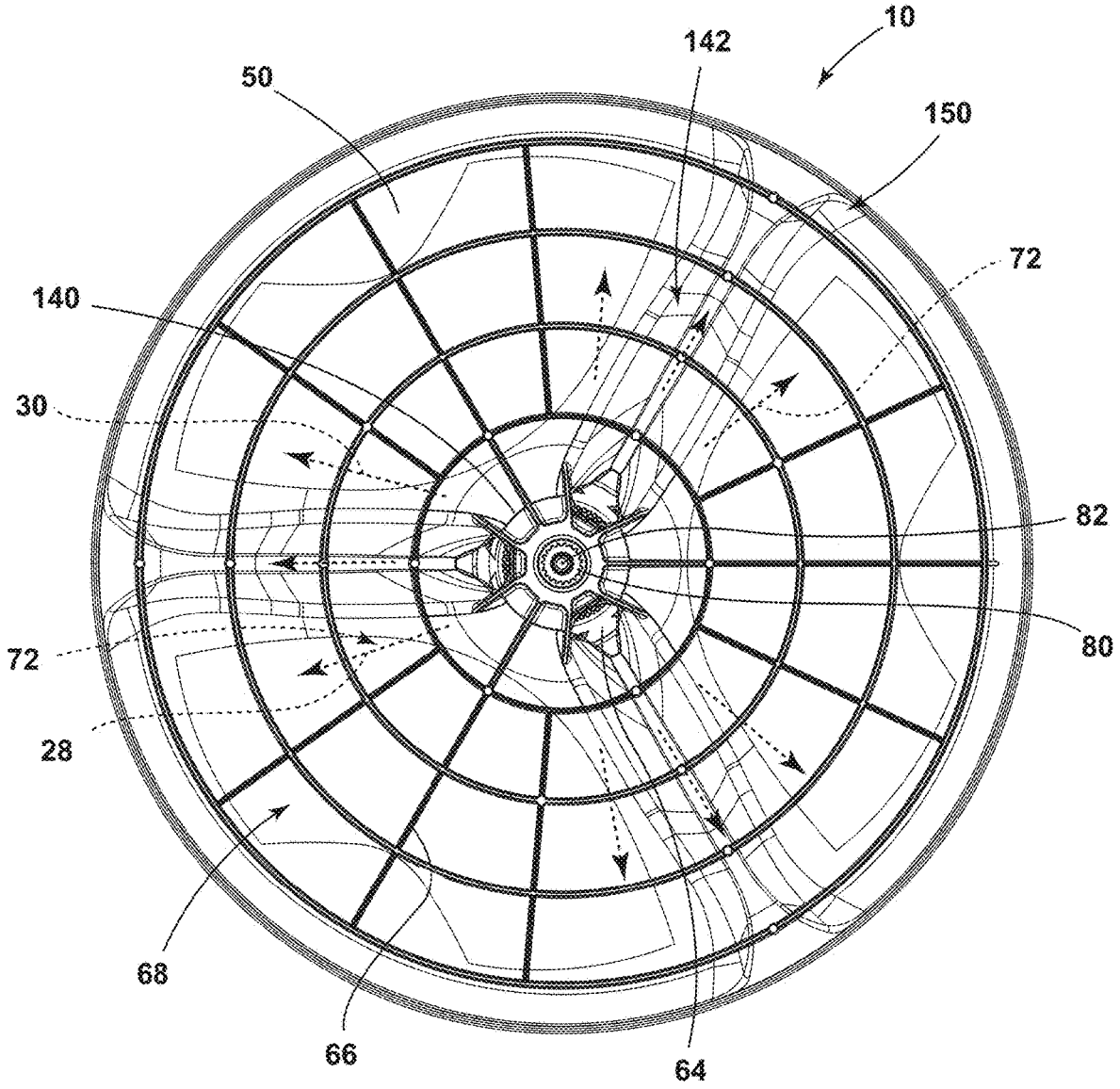
FIG. 10 is a bottom plan view of the agitator of FIG. 6 showing placement of the structural ribs in relation to the flow channels of the agitator.
Figure 11:
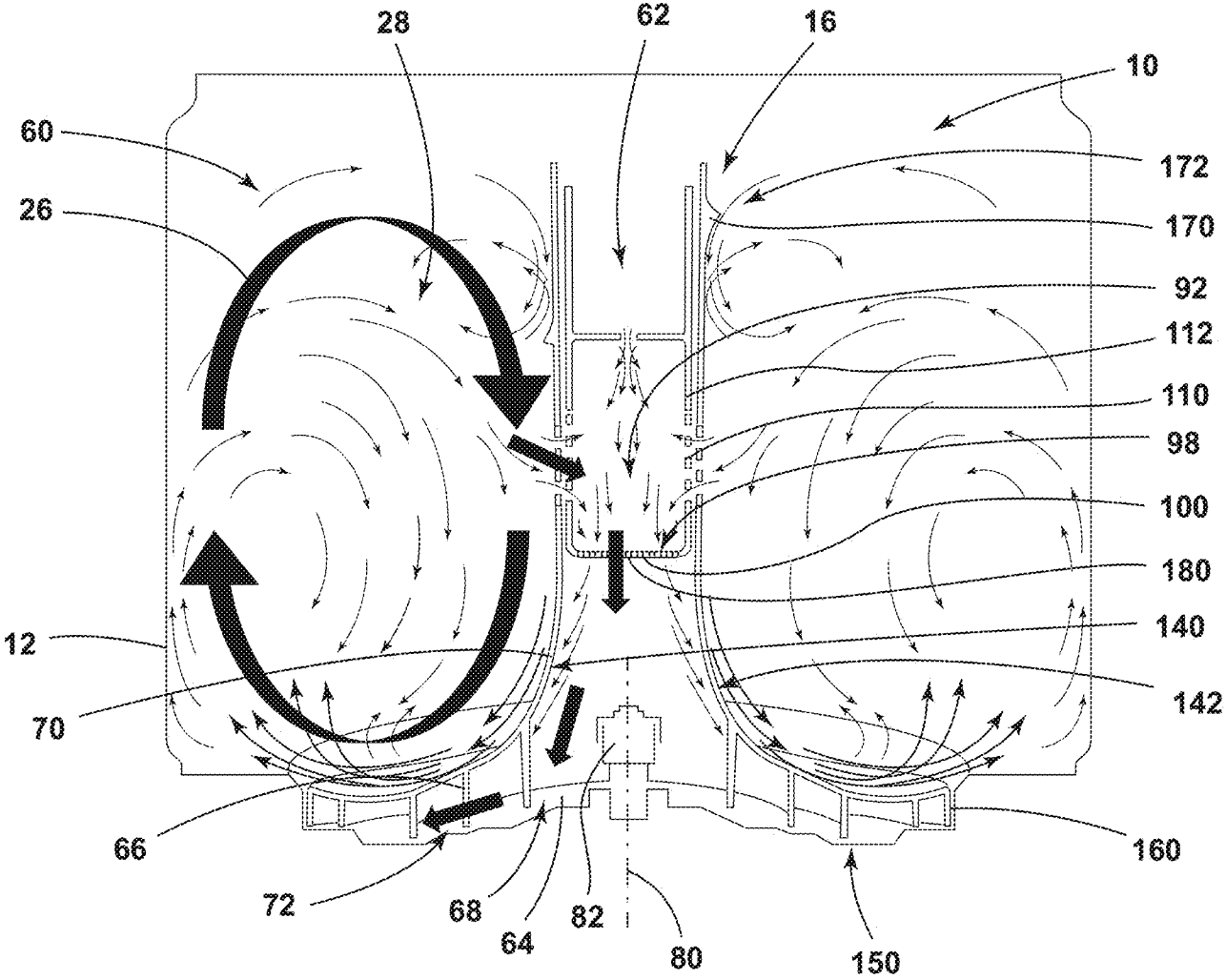
FIG. 11 is a schematic flow diagram illustrating movement of the toroidal flow of wash fluid throughout the rotating drum and the supplemental flow of wash fluid through the agitator of FIG. 6.
Figure 12:
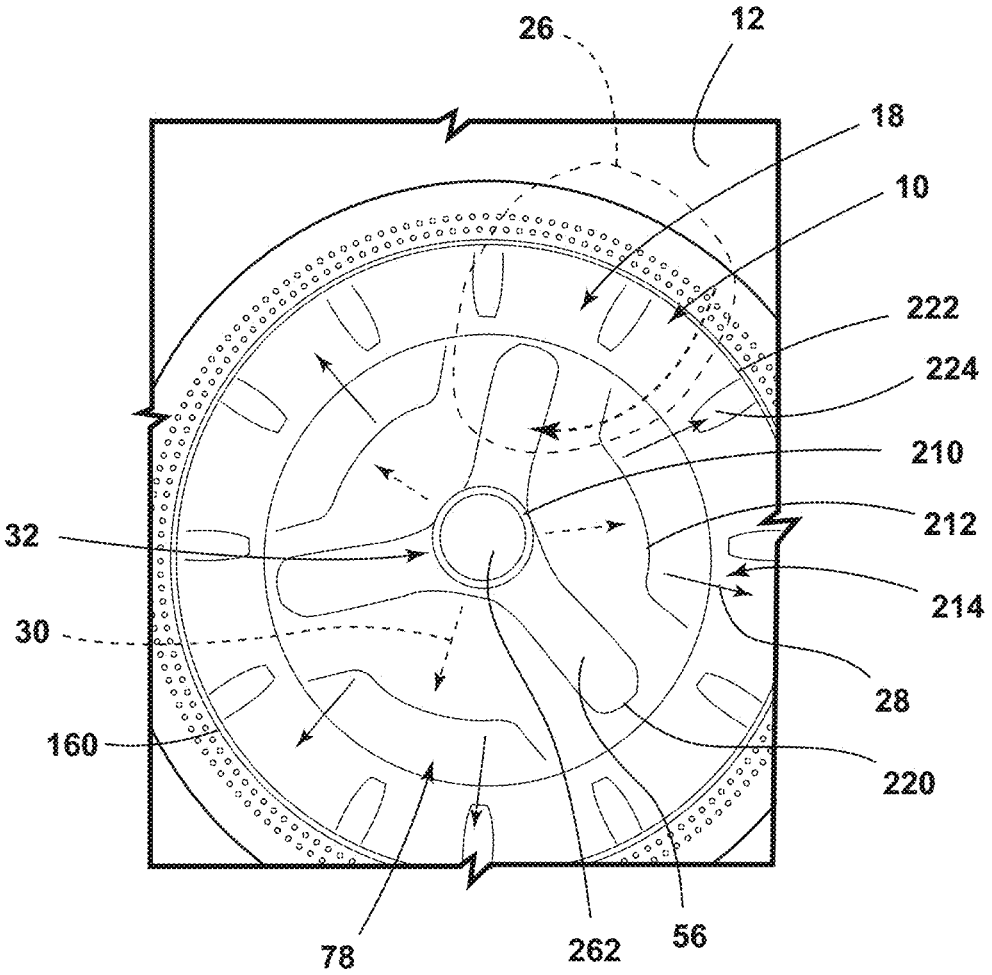
FIG. 12 is a top plan view of the impeller of FIG. 2 that incorporates an aspect of the filtration element and flow structures.
Figure 13:
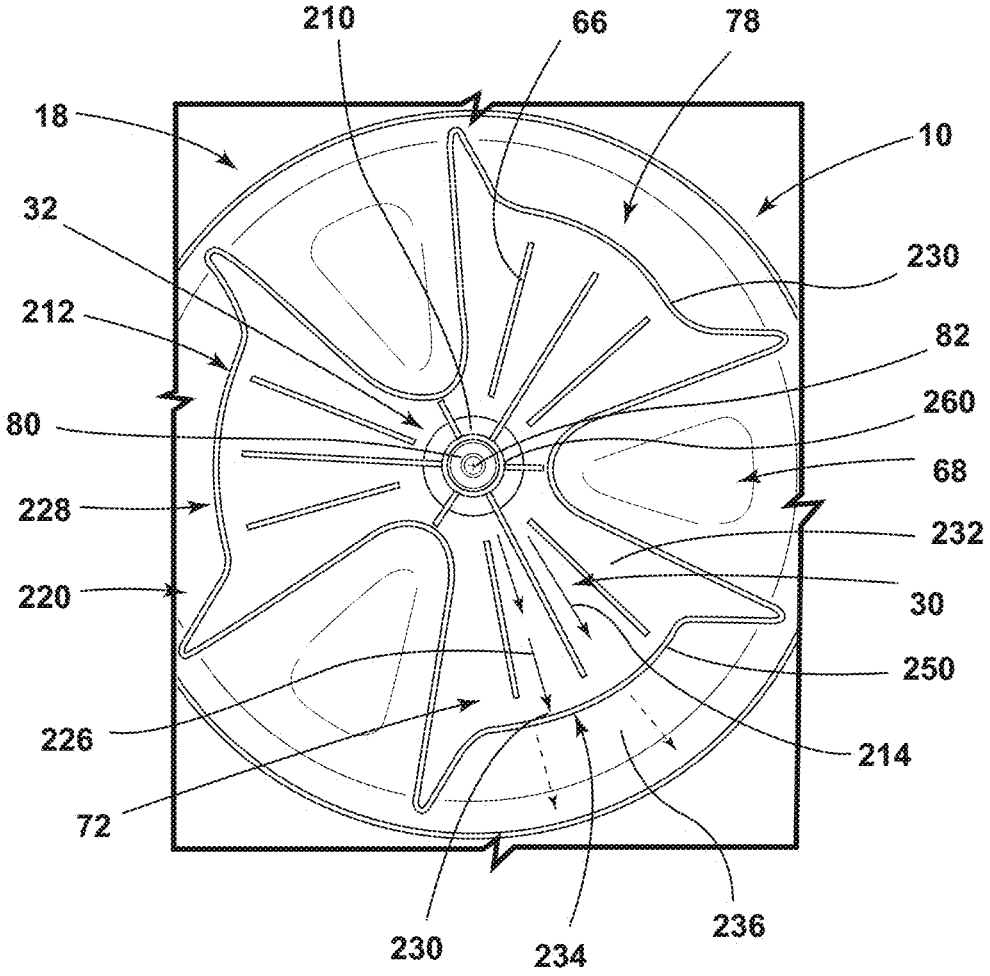
FIG. 13 is a bottom plan view of the impeller of FIG. 12 and showing placement of the outlet channels.
Figure 14:
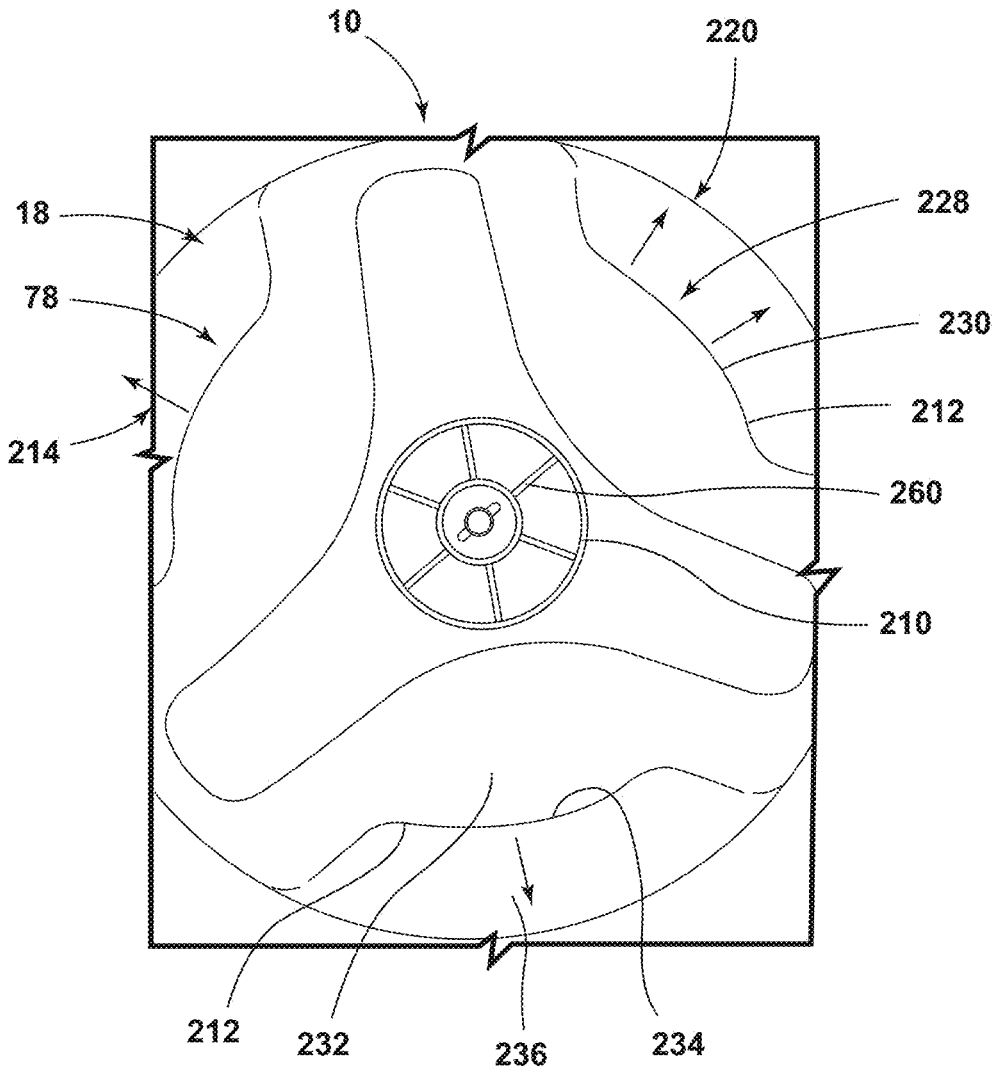
FIG. 14 is a top plan view of the impeller of FIG. 12 with the filtration element and outer circumferential panel removed.
Figure 15:
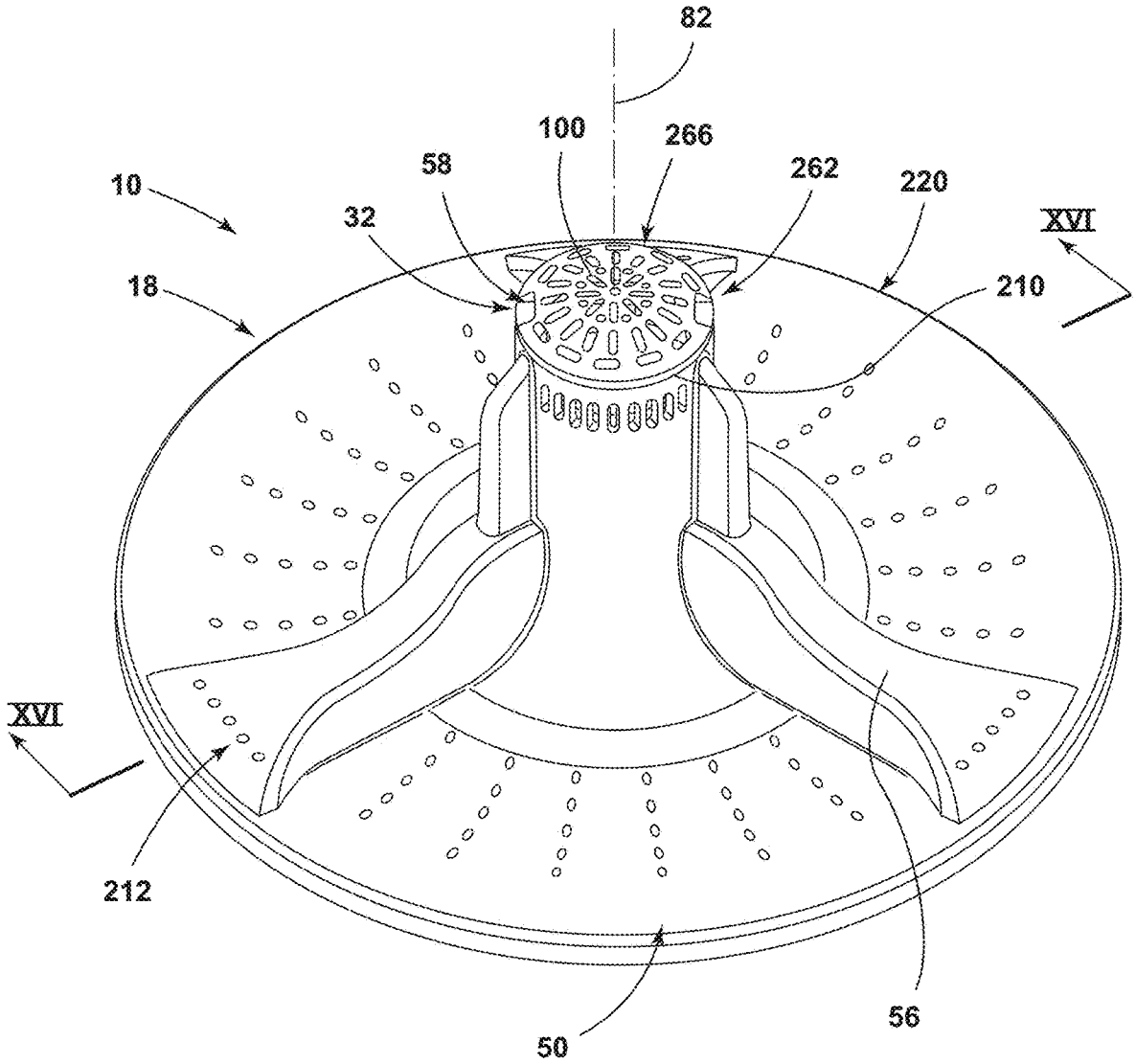
FIG. 15 is a perspective view of an impeller that incorporates an aspect of the filtration element.
Figure 16:
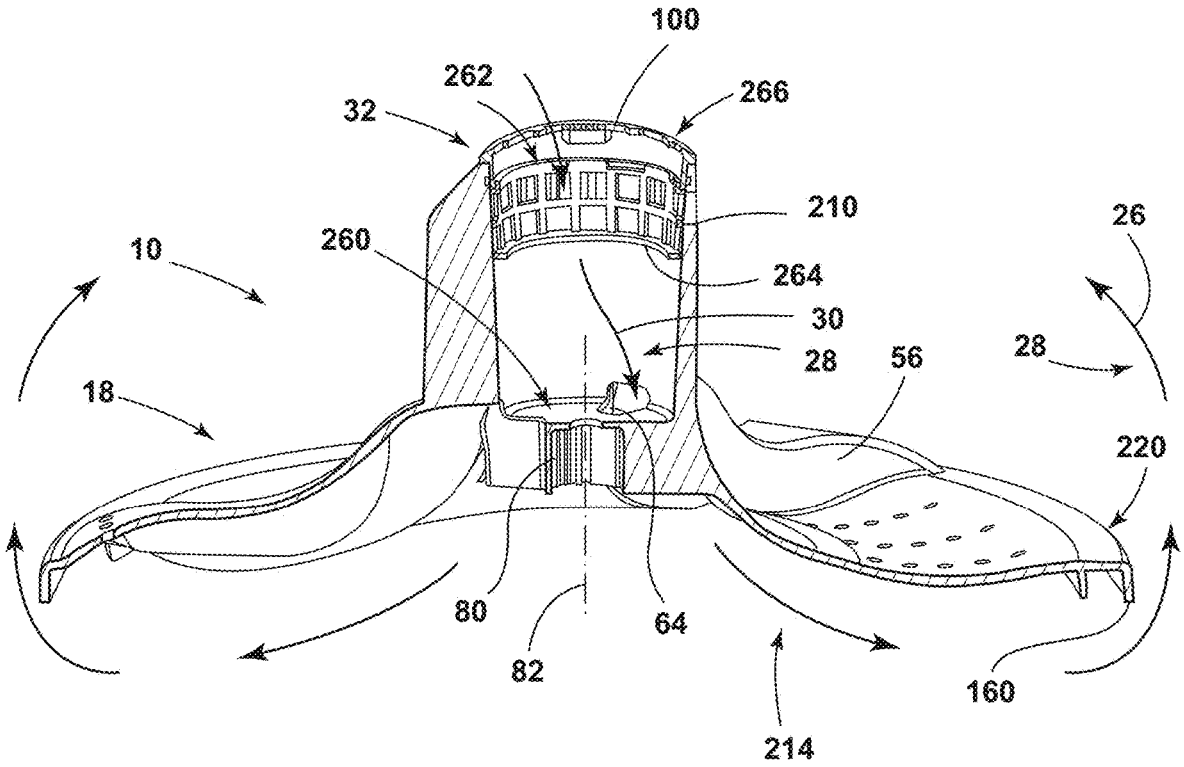
FIG. 16 is a perspective cross sectional view of the impeller of FIG. 15 taken along line XVI-XVI.
Figure 17:
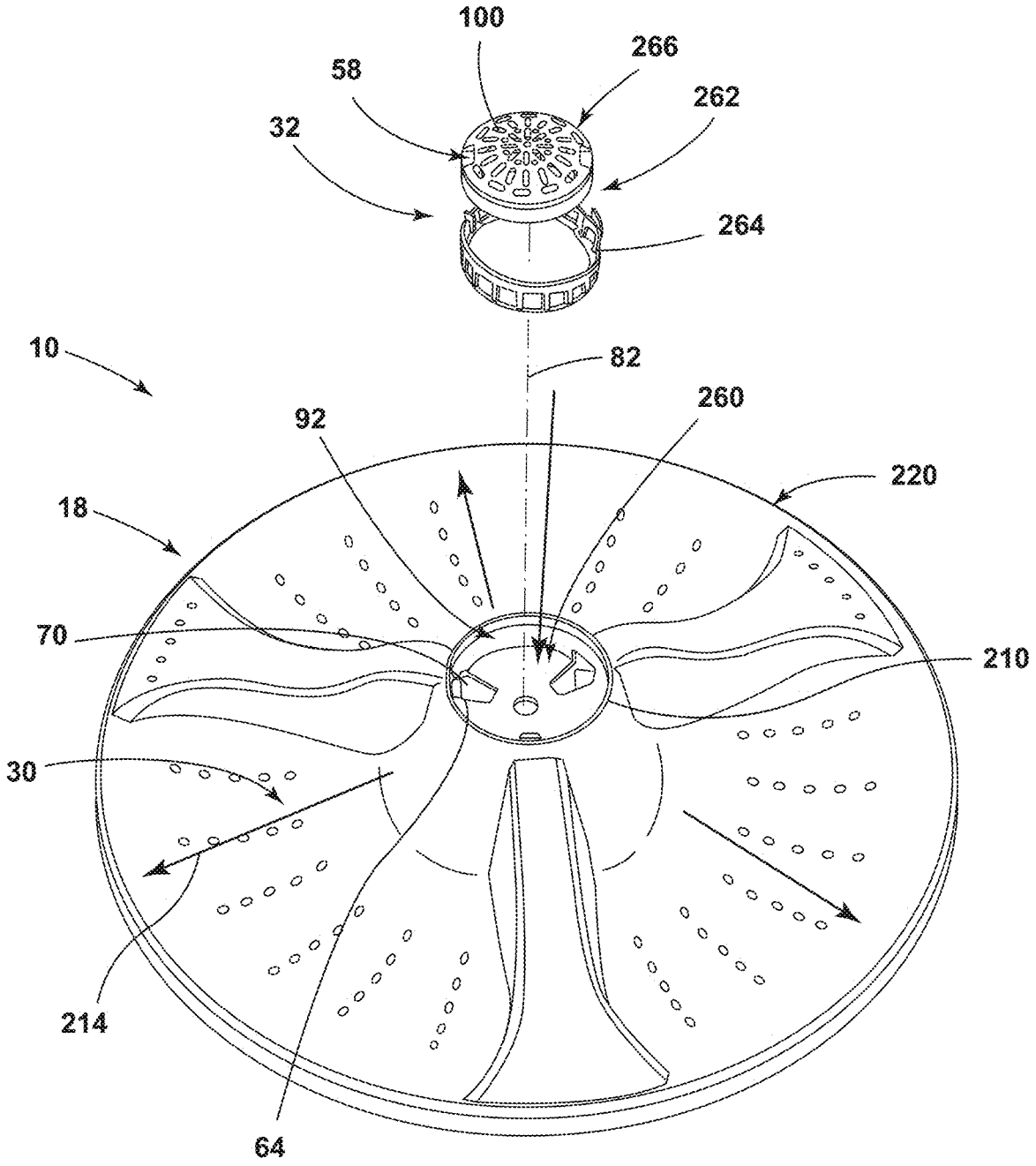
FIG. 17 is an exploded perspective view of the impeller of FIG. 15 showing separation of the filtration element and cover member from the body of the impeller.

As exemplified in FIG. 3, the fluid outlets 64 can be positioned within the exterior wall 52 of the stem 54 such that the wash fluid 28 flows from the fluid inlets 58, through the removable filtration element 74 of the filter assembly 32, and then back into the drum 12 via the fluid outlets 64. In this configuration, the supplemental flow 30 of the wash fluid 28 is contained within the stem 54 of the agitator 16.

As exemplified in FIGS. 6-12, the fluid outlets 64 can also be positioned within an underside 68 of the base 50 and within an area near the central structure 80 for the agitator 16. In this configuration, the wash fluid 28 is directed from the fluid inlets 58, through the removable filtration element 74 and then through the interior flow path 70 and out of the flow outlet 212. The wash fluid 28 is then directed under the structural ribs 66 that form the underside 68 of the base 50 for the agitator 16 and back into the main section of the processing space 60 defined within the rotating drum 12. As discussed herein, the operation of the agitator 16 causes the structural ribs 66 to rotate in a circular motion, and typically in a reciprocating or oscillating pattern, about a rotational axis 82 for the agitator 16. This movement of the structural ribs 66 generates the suction 72 that draws the wash fluid 28 through the agitator 16 and through the interior flow path 70 for the agitator 16.

Referring now to FIGS. 3-6, the removable filtration element 74 of the filter assembly 32 includes an upper cap member 90 that provides an interface for a user to grasp the removable filtration element 74 for inserting the filtration element 74 into, and removing the filtration element 74 from, the filtration chamber 92 for the agitator 16. The filtration chamber 92 includes a seat 94 that receives a sealing rim 96 for the filtration element 74. This engagement provides a blocking mechanism that prevents the wash fluid 28 from moving around the removable filtration element 74. This ensures that the vast majority of the wash fluid 28 within the supplemental flow 30 that moves through the agitator 16 and is filtered to remove particulate material from the wash fluid 28.

The particulate material that is filtered by the filter assembly 32 includes various materials that are expelled or otherwise removed from articles being processed within the drum 12. Such particulate material can include, but is not limited to, fabric strands, lint and pet hair. The particulate material can also include foreign objects and other similar items that may be on the articles being processed or within pockets of articles being processed as well as other objects that are inadvertently placed within the drum 12.

Referring again to FIGS. 3-6, the filtration element 74 can include a rigid filter member 98 having a plurality of perforations 100 that allow for the passage of wash fluid 28 therethrough. The perforations 100 are sized to remove and capture particulate material having a certain diameter or size. These perforations 100 provide for the separation of a majority of the particulate material that may be present within wash fluid 28. The filter assembly 32 includes the filtration element 74 that can collect smaller particulate material. The filter assembly 32 also includes the fluid inlets 58 that are sized to block larger sized particulate material. The fluid inlets 58 are typically sized to block foreign objects such as coins, pens and pen caps, pieces of paper and other similar objects from entering into the interior volume 62 of the agitator 16. Such objects could block a large portion of the perforations 100 of the filtration element 74.

Referring again to FIGS. 3-8, the fluid inlets 58 that are positioned within the exterior wall 52 of the stem 54 for the agitator 16 typically have a configuration that matches filtration inlets 110 that are positioned within a structural wall 112 for the filtration element 74. In this manner, the fluid inlets 58 can be defined by each of the wall for the agitator 16 and the structural wall 112 for the filtration element 74 to allow for the entry of wash fluid 28 to be filtered. In addition, the filtration element 74 can include a particular rotational position 120 within the stem 54 for the agitator 16 to align the various filtration inlets 110 to further define the fluid inlets 58 for the filter assembly 32 for the agitator 16. To achieve the rotational position 120 of the filtration element 74, the wall of the agitator 16 can include various locating mechanisms 114 at or near an upper edge 116 of the agitator 16. These locating mechanisms 114 can be defined within a collar 118 of the agitator 16 and the upper cap member 90 for the removable filtration element 74. These matching locating mechanisms 114 can be used to define a particular rotational position 120 of the removable filtration element 74 within the stem 54 of the agitator 16. These locating mechanisms 114 can also be used to prevent movement, dislodging, sliding, or other unwanted displacement of the filtration element 74 with respect to the agitator 16.

Referring now to FIGS. 4-8, the filter assembly 32 can include an access aperture 130 defined within the structural wall 112 for the filtration element 74. This access aperture 130 can be used for accessing the rigid filter member 98 having the plurality of perforations 100. In this manner, after separating the filtration element 74 from the agitator 16, a user can reach through the side of the filtration element 74, through the access aperture 130, and into the filtration chamber 92 for the filtration element 74. Using the side access aperture 130 the user can wipe, grasp, or otherwise remove captured particulate material from the removable filtration element 74. Once the particulate material is removed, the filtration element 74 can be re-inserted into the agitator 16 for use in subsequent laundry cycles.

According to various aspects of the device, it is contemplated that the removable filtration element 74 of the filter assembly 32 is to be removed and cleaned after each laundry cycle. Certain aspects of the device may provide for less frequent cleaning, such as after every other cycle, every third cycle, or more intermittent cleaning. Various aspects of the device can include sensors or other mechanisms for determining when the perforations 100 included within the filtration element 74 are impacted with particulate material to a point where the flow of wash fluid 28 through the agitator 16 is impeded by the accumulation of particulate material.

It is also contemplated that the filtration element 74 can include more than one filtration member, such as multiple rigid filter members 98 or other similar filtering mechanisms. Each filtration member having perforations 100 of different sizes. In such a configuration, the various filtration members can separate gradually smaller sizes of particulate material. The access aperture 130 can be configured and sized to provide for manual access to each of the filtration members.

Referring now to FIGS. 6-11, the agitator 16 can include a plurality of interior flow channels 140 that extend from the filtration element 74 to corresponding fluid outlets 64 that are positioned within the underside 68 of the agitator 16. These interior flow channels 140 are typically configured to extend from a filtration chamber 92 that can be defined by the engagement between the agitator 16 and the rigid filter member 98 of the filtration element 74 having the perforations 100. These interior flow channels 140 operate to direct the now-filtered wash fluid 28 through a lower portion 142 of the agitator 16 and to the underside 68 of the base 50 for the agitator 16. These interior flow channels 140, as discussed herein, exit the underside 68 of the agitator 16 within an area near the central structure 80 for the agitator 16.

The placement of the fluid outlets 64 at this central location allows for the generation of suction 72 within areas of the base 50 outside of the fluid outlets 64. The structural ribs 66 defined within the underside 68 of the base 50 for the agitator 16 operate in a generally circular motion during an agitating portion of the laundry cycle, as described herein. The structural ribs 66 are positioned toward outer areas 150 of the base 50 for the agitator 16 while the fluid outlets 64 are positioned near the central structure 80 for the agitator 16. This motion of the structural ribs 66 operates to generate an outward motion of the wash fluid 28 away from the central structure 80. This outward motion of the wash fluid 28, in turn, draws the wash fluid 28 from within the interior flow channels 140 and from within the agitator 16. This motion of the wash fluid 28 results in the generation of the suction 72 within an area below the base 50 for the agitator 16 and outside of the fluid outlets 64. This suction 72 near the fluid outlets 64 is used to draw wash fluid 28 through the interior flow channels 140 as discussed herein. In certain aspects of the device, these interior flow channels 140 can be defined within the vanes 56 for the agitator 16, such that these vanes 56 define an expanded portion of the agitator 16 through which the interior flow channels 140 can extend.

As exemplified in FIGS. 8-11, the suction 72 generated by the structural ribs 66 positioned along the underside 68 of the base 50 for the agitator 16 produce suction 72 that generates the supplemental flow 30 of wash fluid 28 through the agitator 16. The external vanes 56 of the agitator 16 contemporaneously operate to produce the toroidal flow 26 of wash fluid 28 through the rotating drum 12. The supplemental flow 30 of the wash fluid 28 through the agitator 16 is typically in the form of a separate flow of wash fluid 28 that operates independently of the toroidal flow 26. Certain amounts of the wash fluid 28 moving in the toroidal flow 26 are typically drawn into the fluid inlets 58 of the agitator 16. The amount of wash fluid 28 suctioned into the fluid inlets 58 of the agitator 16 does not typically or significantly impact the toroidal flow 26 of wash fluid 28 within the drum 12. Similarly, the expulsion of wash fluid 28 away from the agitator 16 and toward an outer edge 160 of the agitator 16 is typically reintroduced into the toroidal flow 26 of wash fluid 28.

Referring again to FIGS. 3-8, the agitator 16 can also include a plurality of auger blades 170 that are positioned within an upper portion 172 of the stem 54 for the agitator 16. These auger blades 170 can extend from the external vanes 56 for the agitator 16 or can be separate members that extend from the exterior wall 52 for the agitator 16. These auger blades 170 operate to enhance the toroidal flow 26 of wash fluid 28 through the rotating drum 12 by assisting at least in the vertical component of the toroidal flow 26 of the wash fluid 28 through the rotating drum 12.

Referring again to FIGS. 1 and 3-11, the appliance 14 described herein can include a tub 20 positioned within the outer cabinet 22. The rotating drum 12 rotates within the tub 20. The fluid flow path 24 directs fluid through the tub 20 and the drum 12. The agitator 16 includes the stem 54 and the base 50 that selectively rotate relative to the drum 12 to generate the toroidal flow 26 of the wash fluid 28 through the drum 12. In addition, the agitator 16 operates to produce the supplemental flow 30 of the wash fluid 28 through the filter assembly 32 that is positioned within the stalk for the agitator 16.

The fluid flow path 24 is typically in the form of a fluid delivery system that delivers water, laundry chemistries and other materials that make up the wash fluid 28. Over the course of a particular laundry cycle, the wash fluid 28 can also accumulate particulate material from the articles being processed. Accordingly, at certain points in the laundry cycle, the wash fluid 28 includes the particulate material. This wash fluid 28 can be recycled through the fluid flow path 24 or directed to a fluid outlet 64 after a particular portion of a laundry cycle is completed.

According to various aspects of the device, the removable filtration element 74 for the filter assembly 32 includes the perforated rigid filter member 98 that is positioned at a lower end 180 of the filtration element 74. This filtration element 74 can also include mesh filters, porous membranes, removable and disposable filters, combinations thereof, and other similar filtration mechanisms that can operate within the removable filtration element 74 for the agitator 16.

As exemplified in FIGS. 6-10, the interior flow path 70 can extend from the filtration chamber 92, through the various interior flow channels 140 and through fluid outlets 64 that are positioned within the underside 68 of the base 50 for the agitator 16. These apertures that define the fluid outlets 64 can be defined between adjacent structural ribs 66 for the agitator 16, and can be aligned along the external vanes 56, or can be spaced between the external vanes 56 for the agitator 16.

Referring now to FIGS. 2 and 12-17, the appliance 14 can include a rotator 10 in the form of an impeller 18 that is positioned within a lower portion 142 of the drum 12. The impeller 18 typically operates in a fashion similar to that of the agitator 16 described herein to produce a rotational and oscillating motion within the rotating drum 12. According to various aspects of the device, the appliance 14 includes the tub 20 that is positioned within the outer cabinet 22. The rotating drum 12 rotates within the tub 20 and a fluid flow path 24 directs wash fluid 28 through the tub 20 and the drum 12. The impeller 18 includes the base 50 and the filter assembly 32 that is positioned within a top aperture 210 of the base 50. Selective rotation of the impeller 18 relative to the drum 12 generates a toroidal flow 26 of the wash fluid 28 through the drum 12. In addition, a supplemental flow 30 of the wash fluid 28 is directed through the top aperture 210 of the base 50 and through the filter assembly 32 of the impeller 18. Flow outlets 212 are positioned within the base 50 of the impeller 18 for directing the wash fluid 28 in an outward direction 214 to be reintroduced into the toroidal flow 26 of washing fluid within the drum 12. The flow outlets 212 are typically positioned within a medial portion 78 of the base 50 between the central structure 80, including the stem 54, and the outer edge 160.

Referring again to FIGS. 12-17, the impeller 18 includes a primary section or body 220 that includes the top aperture 210, various external vanes 56, and the flow outlets 212 that are positioned within the impeller 18. An outer ring 222 includes various undulating features 224 that assist in providing cleaning action as the impeller 18 operates during performance of various laundry cycles for the appliance 14. The outer ring 222 can be fixedly attached to the body 220 of the impeller 18 so that these components move in a unitary fashion about the rotational axis 82 of the impeller 18. Structural ribs 66 of the impeller 18 are positioned within an underside 68 of the body 220 for the impeller 18. The structural ribs 66 produce radiating flow channels 226 that extend outward from the central structure 80 and the rotational axis 82 of the impeller 18. These structural ribs 66 define the flow of wash fluid 28 in the outward direction 214 from the centrally positioned top aperture 210 and to the flow outlets 212. This suction, as described herein, produces the supplemental flow 30 of wash fluid 28 through the impeller 18. The flow outlets 212 of the impeller 18 are defined within the surface of the impeller 18, typically within the medial portion 78, and include a stepped configuration 228 that defines a slot 230 through which the wash fluid 28 can leave the impeller 18 to be re-introduced into the toroidal flow 26 of wash fluid 28 within the drum 12. Accordingly, the stepped configuration 228 of the impeller 18 at each of the flow outlets 212 includes an interior portion 232 of the step 234 that is elevated above an outer portion 236 of the step 234 with the slot 230 formed therebetween. The difference between the inner portion and the outer portion 236 of the step 234 within the body 220 produces the flow outlet 212 through which the wash fluid 28 is directed back into the toroidal flow 26 of washing fluid within the drum 12.

Referring again to FIGS. 12-17, the structural ribs 66 extend outward from the rotational axis 82 of the impeller 18 and direct the wash fluid 28 toward each respective slot 230. In addition, a continuous outer rib 250 can be defined around each of the flow outlets 212 and also between each set of radiating flow channels 226 that extends from the top aperture 210 of the impeller 18 to the flow outlets 212. Accordingly, the flow of wash fluid 28 from the top aperture 210 and towards the flow outlets 212 can be defined within this outer rib 250 that outlines the various flow outlets 212 for the impeller 18 for directing wash fluid 28. The flow outlets 212 are typically in the form of slots 230 that are defined within the impeller 18. These flow outlets 212 can also be in the form of perforations 100, individual apertures, channels, and other outlet configurations that allow wash fluid 28 to move away from the underside 68 of the impeller 18 and into the remainder of the drum 12 for the appliance 14.

Referring again to FIGS. 12-17, the top aperture 210 can include a support structure 260 that supports a filter cup 262 that is positioned within the top aperture 210. This filter cup 262 can include a mesh membrane, perforations 100, or other filtering member that can be used to separate particulate material from the wash fluid 28 that moves through the filter assembly 32 for the impeller 18. Positioned below the filter cup 262 is a flow directing ring 264 that is also positioned within the top aperture 210. This flow directing ring 264 allows for the movement of wash fluid 28 in the lateral direction and outward toward the radiating flow channels 226 and to the various flow outlets 212 of the impeller 18. The flow directing ring 264 can include a series of openings that direct the wash fluid 28 from the filtration chamber 92 defined within the filter cup 262 and outward to the various flow outlets 212. Positioned above the filter cup 262 is a cover 266 that extends over the top aperture 210. This cover 266 can include various perforations 100 that allow for the movement of wash fluid 28 into the top aperture 210. At the same time, the cover 266 prevents clothing from entering into the filtration chamber 92 or otherwise interfering with the operation of the filter assembly 32 for the impeller 18.

Referring again to FIGS. 15-17, the impeller 18 can include the plurality of internal radiating flow channels 226 that can be directed from the top aperture 210 and toward an outer portion 236 of the agitator 16. In this manner, the structural ribs 66 positioned on the underside 68 of the impeller 18 can cooperate with the operation of the impeller 18 in a fashion similar to that of the structural ribs 66 exemplified in FIGS. 4-11. As discussed herein, the structural ribs 66 provide a suction 72 that draws wash fluid 28 from an area above the impeller 18 so that wash fluid 28 can be drawn in through the top aperture 210, through the filter cup 262 of the filter assembly 32, and then through the radiating fluid paths. The suction 72 generated by the structural ribs 66 then moves the wash fluid 28 in an outward direction 214 and past an outer edge 160 of the impeller 18 to be reintroduced into the toroidal flow 26 of washing fluid through the rotating drum 12.

According to the various aspects of the device, the rotator 10 described herein can be in the form of an agitator 16 or an impeller 18 that can operate within the rotating drum 12. Typically, the rotating drum 12 and the rotator 10 can operate independently of one another via operation of two separate rotors within the motor assembly 280 for the appliance 14. The motor assembly 280 can also cooperate to rotate the rotator 10 and the drum 12 as a unit, such as during a spin cycle. During various cleaning or agitating portions of a wash cycle, it is typical that the rotating drum 12 and the rotator 10 operate cooperatively, but at different directions, distances and speeds with respect to one another. This cooperative but dissimilar operation between the rotating drum 12 and the rotator 10 operates to produce the toroidal flow 26 of wash fluid 28 through the drum 12 as well as the supplemental flow 30 of wash fluid 28 through the rotator 10 and through the filter assembly 32 of the rotator 10 that is positioned within the rotating drum 12. According to various aspects of the device, the filter assembly 32 typically includes one or more filtration members that can be removed from the rotator 10 after each laundry cycle. In this manner, the filter assembly 32 can be a reusable component that can be cleaned and replaced after each cycle. Components of the removable filter assembly 32 can also be removed and disposed of or recycled between laundry cycles.

According to the various aspects of the device, the rotator 10 is used within a vertical axis laundry appliance 14. It is contemplated, in certain aspects, that versions of the impeller 18 can be utilized within a horizontal axis laundry appliance 14. It is also contemplated that variations of the rotator 10, either in the form of the agitator 16 or the impeller 18, can be utilized within other appliances 14 that require movement of process fluid through a processing space 60.

According to one aspect of the present disclosure, a washing appliance includes a tub positioned within an outer cabinet. A rotating drum rotates within the tub. A fluid flow path directs wash fluid through the tub and the drum. A rotator selectively rotates relative to the drum to generate at least a toroidal flow of the wash fluid through the drum and a supplemental flow of the wash fluid through a filter assembly positioned within the rotator.

According to another aspect, the rotator is an agitator that has a stem and a plurality of external vanes and an interior set of ribs. The external vanes and the interior set of ribs produce the toroidal flow of the wash fluid within the drum and the supplemental flow of the wash fluid through the filter assembly.

According to another aspect, the supplemental flow of the wash fluid is directed through an exterior wall of the stem and through the filter assembly.

According to another aspect, the filter assembly includes a rigid filter member that has a plurality of perforations.

According to another aspect, the filter assembly includes a side access aperture that provides access to the rigid filter member. The side access aperture is configured to allow for extraction of captured particulate material from the filter assembly.

According to another aspect, the agitator includes a plurality of fluid outlets that are defined within a base of the agitator. The plurality of fluid outlets directs the supplemental flow of the wash fluid through the base and to an underside of the agitator.

According to another aspect, the plurality of fluid outlets are aligned with the plurality of external vanes, respectively.

According to another aspect, rotation of the agitator causes the interior set of ribs to produce a suction that generates the supplemental flow of the wash fluid through the filter assembly and through the plurality of fluid outlets.

According to another aspect, the rotator is an impeller, wherein the supplemental flow of the wash fluid is directed through a top aperture of the impeller and through the filter assembly.

According to another aspect, the filter assembly includes a ring that has a side aperture and a cap member.

According to another aspect, the impeller includes a plurality of fluid outlets that are defined within a base of the impeller. The plurality of fluid outlets directs the supplemental flow of the wash fluid through the base and a plurality of respective flow outlets. The flow outlets are positioned within a medial portion of the base between external vanes of the impeller.

According to another aspect, the filter assembly includes a mesh filter.

According to another aspect, the filter assembly is disposed within a filtration chamber. The filtration chamber extends to a plurality of flow channels that are positioned proximate a plurality of external vanes of the rotator.

According to another aspect, the filter assembly is selectively removable from the rotator via a top aperture of the rotator.

According to another aspect of the present disclosure, a washing appliance includes a tub positioned within an outer cabinet. A rotating drum rotates within the tub. A fluid flow path directs wash fluid through the tub and the drum. An agitator has a stem and a base and selectively rotates relative to the drum to generate a toroidal flow of the wash fluid through the drum and a supplemental flow of the wash fluid through a filter assembly is positioned within the stem of the agitator.

According to another aspect, the agitator includes a plurality of external vanes and an interior set of ribs. The external vanes and the interior set of ribs produce the toroidal flow of the wash fluid within the drum and the supplemental flow of the wash fluid through the filter assembly.

According to another aspect, the agitator includes a plurality of fluid outlets that are defined within the base of the agitator. The plurality of fluid outlets directs the supplemental flow of the wash fluid through the base and to an underside of the agitator. Rotation of the agitator causes an interior set of ribs to produce a suction that generates the supplemental flow of the wash fluid through the filter assembly and through the plurality of fluid outlets.

According to yet another aspect of the present disclosure, a washing appliance includes a tub positioned within an outer cabinet. A rotating drum rotates within the tub. A fluid flow path directs wash fluid through the tub and the drum. An impeller has a base and a filter assembly that is positioned within a top aperture of the base. Selective rotation of the impeller relative to the drum generates a toroidal flow of the wash fluid through the drum and a supplemental flow of the wash fluid through the filter assembly.

According to another aspect, the impeller includes a plurality of fluid outlets that are defined within the base of the impeller. The plurality of fluid outlets directs the supplemental flow of the wash fluid through the base and the plurality of respective flow outlets. The flow outlets are positioned within a medial portion of the base between a plurality of external vanes of the impeller.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A washing appliance comprising:

a tub positioned within an outer cabinet;

a rotating drum that rotates within the tub;

a fluid flow path that directs wash fluid through the tub and the drum; and a rotator that selectively rotates relative to the drum to generate at least a toroidal flow of the wash fluid through the drum and a supplemental flow of the wash fluid through a filter assembly positioned within the rotator, wherein the rotator is an impeller, wherein the supplemental flow of the wash fluid is directed through a top aperture of the impeller and through the filter assembly, and wherein the filter assembly includes a ring having a side aperture and a cap member.

2. The washing appliance of claim 1, wherein the impeller includes a plurality of fluid outlets that are defined within a base of the impeller, wherein the plurality of fluid outlets directs the supplemental flow of the wash fluid through the base and a plurality of respective flow outlets, wherein the flow outlets are positioned within a medial portion of the base between external vanes of the impeller.

3. The washing appliance of claim 1, wherein the filter assembly includes a filter member, and wherein the filter member and the cap member are removable from the impeller.

4. The washing appliance of claim 1, wherein the filter assembly includes a mesh filter.

5. The washing appliance of claim 1, wherein the filter assembly is disposed within a filtration chamber, wherein the filtration chamber extends to a plurality of flow channels that are positioned proximate a plurality of external vanes of the rotator.

6. The washing appliance of claim 1, wherein the filter assembly is selectively removable from the rotator via the top aperture of the impeller.

7. A washing appliance comprising:

a tub positioned within an outer cabinet;

a rotating drum that rotates within the tub;

a fluid flow path that directs wash fluid through the tub and the drum; and an agitator having a stem and a base selectively rotates relative to the drum to generate a toroidal flow of the wash fluid through the drum and a supplemental flow of the wash fluid through a filter assembly positioned within the stem of the agitator, wherein the agitator includes a plurality of fluid outlets that are defined within the base of the agitator, wherein the plurality of fluid outlets directs the supplemental flow of the wash fluid through the base and to an underside of the agitator, and wherein rotation of the agitator causes an interior set of ribs to produce a suction that generates the supplemental flow of the wash fluid through the filter assembly and through the plurality of fluid outlets.

8. The washing appliance of claim 7, wherein the agitator includes a plurality of external vanes and the interior set of ribs, wherein the external vanes and the interior set of ribs produces the toroidal flow of the wash fluid within the drum and the supplemental flow of the wash fluid through the filter assembly.

9. The washing appliance of claim 8, wherein the plurality of fluid outlets are aligned with the plurality of external vanes, respectively.

10. The washing appliance of claim 7, wherein the supplemental flow of the wash fluid is directed through an exterior wall of the stem and through the filter assembly.

11. The washing appliance of claim 10, wherein the filter assembly includes a rigid filter member having a plurality of perforations.

12. The washing appliance of claim 11, wherein the filter assembly includes a side access aperture that provides access to the rigid filter member, the side access aperture configured to allow for extraction of captured particulate material from the filter assembly.

13. A washing appliance comprising:

a tub positioned within an outer cabinet;

a rotating drum that rotates within the tub;

a fluid flow path that directs wash fluid through the tub and the drum; and an impeller having a base and a filter assembly positioned within a top aperture of the base, wherein selective rotation of the impeller relative to the drum generates a toroidal flow of the wash fluid through the drum and a supplemental flow of the wash fluid through the filter assembly, wherein the impeller includes a plurality of fluid outlets that are defined within the base of the impeller, wherein the plurality of fluid outlets directs the supplemental flow of the wash fluid through the base and the plurality of respective fluid outlets, and wherein the fluid outlets are positioned within a medial portion of the base between a plurality of external vanes of the impeller.

14. The washing appliance of claim 13, wherein the impeller includes a plurality of fluid outlets that are defined within a base of the impeller.

15. The washing appliance of claim 14, wherein the plurality of fluid outlets directs the supplemental flow of the wash fluid through the base and a plurality of respective fluid outlets.

16. The washing appliance of claim 13, wherein the filter assembly includes a filter member and a cap member, and wherein the filter member and the cap member are removable from the impeller.

17. The washing appliance of claim 13, wherein the filter assembly includes a mesh filter.

18. The washing appliance of claim 13, wherein the filter assembly is disposed within a filtration chamber.

19. The washing appliance of claim 18, wherein the filtration chamber extends to a plurality of flow channels that are positioned proximate a plurality of external vanes of the impeller.

20. The washing appliance of claim 13, wherein the filter assembly is selectively removable from the impeller via a top aperture of the base.

* * * * *